US005090340A

United States Patent [19]

Burgess

[11] Patent Number: 5,090,340

[45] Date of Patent: Feb. 25, 1992

[54] PLASMA DISINTEGRATION FOR WASTE MATERIAL

[76] Inventor: Donald A. Burgess, 5165 Keysville Ave., Spring Hill, Fla. 34608

[21] Appl. No.: 739,410

[22] Filed: Aug. 2, 1991

[51] Int. Cl.[5] ..... F23G 5/00; F23G 5/10

[52] U.S. Cl. ..... 110/346; 110/250; 219/121.48; 219/121.49; 219/121.50; 219/121.51; 373/22; 373/24

[58] Field of Search ..... 110/235, 250, 346; 373/24, 22, 18; 219/121.48, 121.50, 121.49, 121.51

[56] References Cited

U.S. PATENT DOCUMENTS 4,119,828 10/1978 Bykhovsky et al. ..... 219/121.48
4,181,504 1/1980 Camacho ..... 110/250 X
4,509,434 4/1985 Bóday .
4,630,555 12/1986 Guillaume et al. .
4,761,793 8/1988 Digme et al. ..... 373/24
4,770,109 9/1988 Schlienger .
4,831,944 5/1989 Durand et al. .
4,909,164 3/1990 Shohet et al. ..... 110/346
4,980,092 12/1990 Pineau et al. .
5,010,829 4/1991 Kulkarni ..... 110/346

*Primary Examiner*—Edward G. Favors
*Attorney, Agent, or Firm*—Leonard Belkin

[57] ABSTRACT

Apparatus and method for the disintegration of waste by subjecting the waste within a closed chamber to plumes of an electrically generated high temperature plasma. The chamber is lined with an array of nozzles to produce the plumes and the nozzles are supplied with a cooling gas at all times. The nozzles are energized to produce the plumes in a predetermined sequential manner so that the waste is destroyed in steps, or bites. The gas containing the products of disintegration is withdrawn and filtered. One embodiment comprises a portable device capable of disintegrating waste over a large area such as at a waste dump site.

12 Claims, 4 Drawing Sheets

FIG. 9
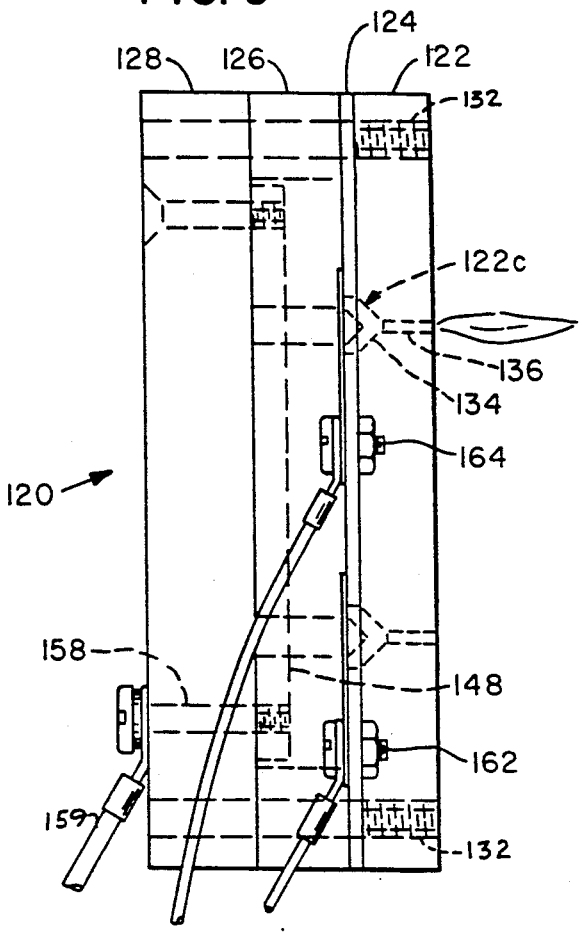
FIG. 10
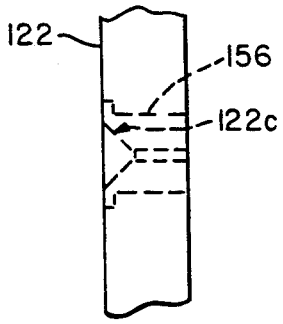
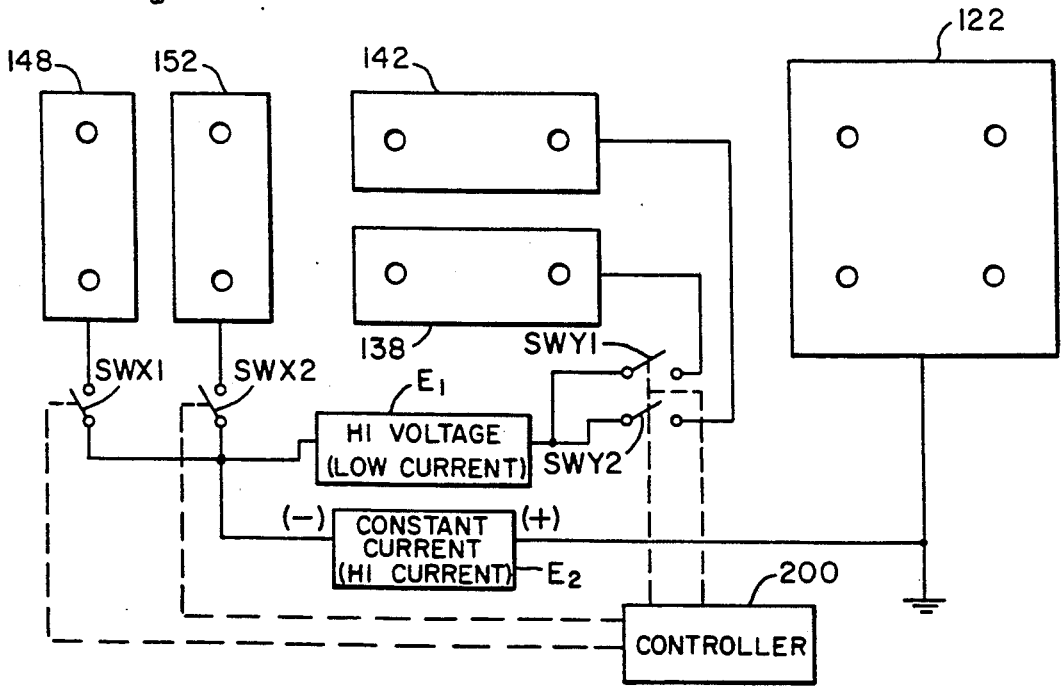
FIG. 11

PLASMA DISINTEGRATION FOR WASTE MATERIAL

BACKGROUND OF THE INVENTION

The present invention relates to waste disposal and more particularly to waste disposal employing plasma flame.

The use of plasma flame to heat or disintegrate material has been known and used for some time.

The advantage of a plasma flame in such an application is the intense heat that can be generated (ie, 10,000 C), and when applied to any material, will cause complete dissociation of the compounds. As applied to certain waste materials, such as medical waste, it assures the absolute destruction of any form of organic residue, additionally, it melts dangerous sharp objects and glassware, producing an atomically clean residue. By atomically clean is meant that by complete plasma treatment, the resultant products comprise substantially only atomic elements in vapor form. By-products of a plasma fired disintegrator can be controlled by appropriate means to consist of simple elemental gases, carbon, metals, and environmentally safe compounds.

A number of disadvantages of utilizing a plasma flame to destroy waste products have prevented or limited its use. The plasma flame is very small compared to the bulk of material that is to be treated. This requires extensive pretreatment of the waste products, such as the need to compact, pulp, and/or shred the material to reduce it to a suitable size that the flame can handle prior to feeding the products to the flame plume. In the case of hazardous waste, the pre-treating apparatus will become contaminated, thus increasing the problems involved in handling such materials.

Another problem associated with present plasma systems is that the nozzles are subjected to accelerated erosion requiring frequent and extended periods of down time to replace the nozzles. When air is employed as the plasma gas, the presence of oxygen contributes significantly to the erosion problem. If another gas is employed, such as nitrogen, to avoid the presence of oxygen, this increases the costs substantially and renders the system less competitive than other waste disposal systems.

A number of United States Patents have been issued which describe the use of plasma for the destruction of waste products.

U.S. Pat. No. 4,509,434 discloses a plasma waste disposal system utilizing an oxidizing agent intended for fluid waste. It refers to combustion products and there is no provision for handling solid waste.

U.S. Pat. No. 4,630,555 shows an incinerating process using a nozzle for injecting pure oxygen and a liquid, maintaining a temperature between 600° C. and 1000° C. The process does not use a plasma flame and its primary goal is to control combustion products by controlling temperatures.

U.S. Pat. No. 4,770,109 teaches a complex arrangement for applying a plasma flame to a large area of waste material by rotating the waste material chamber under the plasma flame generator. This patent also requires pre-digesting the material to feed into the chamber.

U.S. Pat. No. 4,831,944 describes a system in which a column of solid waste is consumed by ordinary combustion and the nonconsumable waste drops to the where it is further reduced by plasma flames. Oxygen is introduced to encourage combustion.

U.S. Pat. No. 4,980,092 teaches the destruction of cyanided organic and organo-chlorinated waste materials by shredding, pulping, and extruding the waste through a restricting orifice and feeding the product to the plasma flame. Contamination of the shredding apparatus would appear to be a significant unresolved problem.

None of the preceding teaches or suggests the present invention.

SUMMARY OF THE INVENTION

In this invention a plasma flame is utilized to disintegrate material, especially waste material and more particularly medical waste material, that overcomes drawbacks of other methods and adds measureably to the effectiveness and practicality of the art of plasma flame use.

A preferred embodiment of this invention comprises the use of a plurality of plasma generator nozzles presented in an array within a container in which the waste is placed. A high temperature flame plume of plasma is generated serially by the nozzles in a manner in which the rate, period and sequence is selectable depending on the size and configuration of the waste products. By high temperature is meant that the plasma is sufficiently hot to vaporize substantially all of the products appearing in the waste to be disintegrated. Because of the shared aspect of the plasma flame generation, the operating life of each nozzle will be extended substantially, especially since there will be ample time to conduct cooling between the periods of operation for each of the nozzles.

By appropriate configuration, disintegration chambers may be designed to accept waste of any size, shape or description, without any pretreatment of the waste, and yet completely disintegrating the material and assuring that the residue will comprise substantially only gaseous and/or elemental by-products.

In this invention, power requirements have little or nothing to do with the size or bulk of the material to be disintegrated, except as it may affect time required. Typically, the disposal of hazardous medical waste material with a bulk of approximately one cubic foot, the typical size of a red bag, only about 1.5KW of power could be capable of consuming a typical red bag.

It is thus a principal object of this invention to provide for the total and safe destruction of waste and/or contaminants utilizing plasma flames in a more efficient and effective manner than has been heretofor possible.

Other objects and advantages of this invention will hereinafter become obvious from the following description of preferred embodiments of this invention.

BRIEF DESCRIPTION OF THE DRAWINGS

FIG. 9 is an end view of the embodiment shown in FIG. 8.

FIG. 10 is a detail of one of the nozzles employed in the embodiment of FIGS. 8-9.

FIG. 11 is a schematic of the control system used for the embodiment of FIGS. 8-10.

DESCRIPTION OF THE PREFERRED EMBODIMENTS

Figure 2:
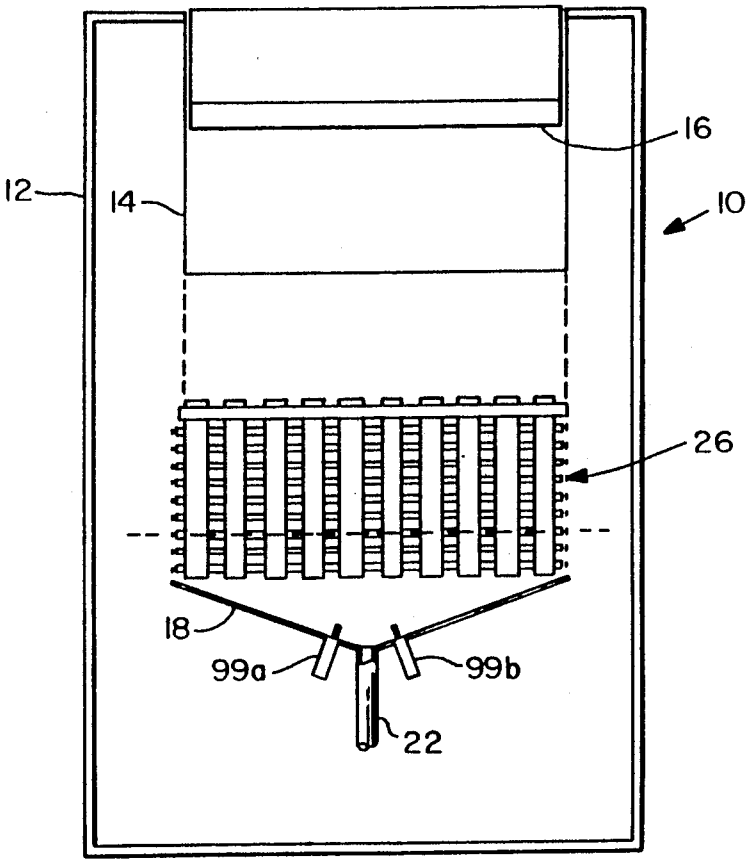
FIG. 2 is a view taken along 2—2 of FIG. 1 with the wall cut away to show the interior.
Figure 1:
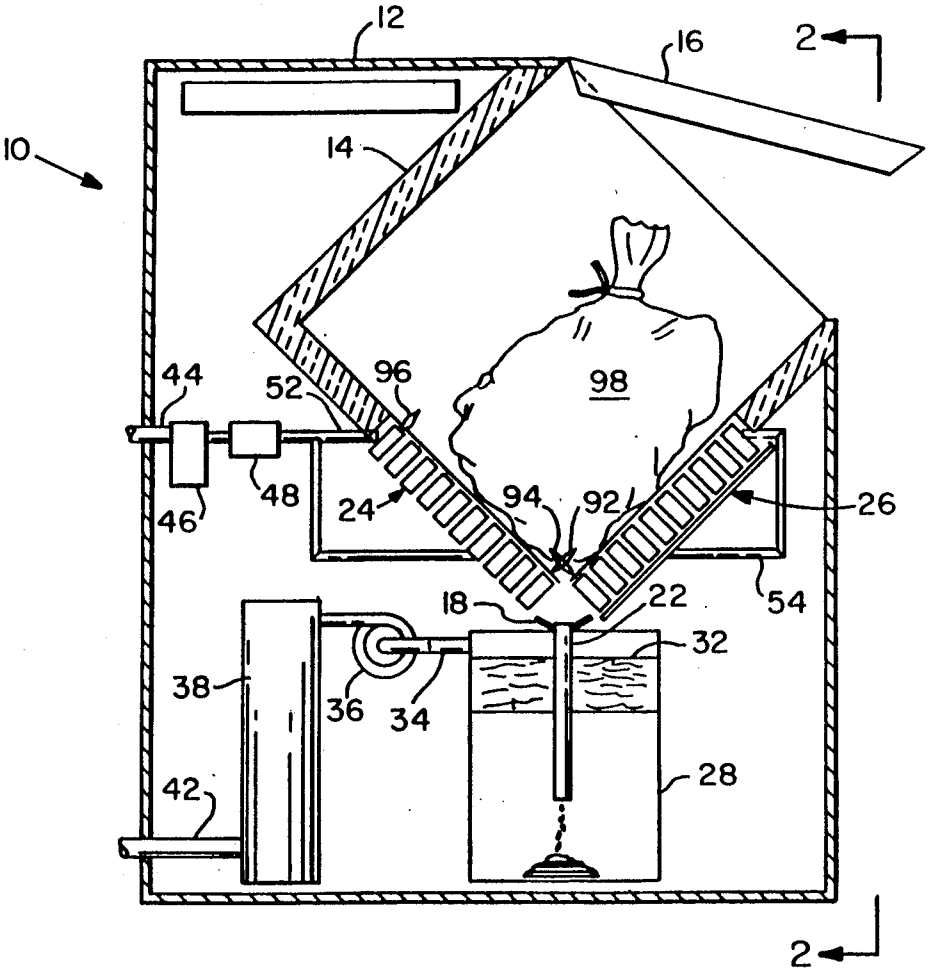
FIG. 1 is a diagrammatic view in cross section of one preferred embodiment of this invention.
Figure 5:
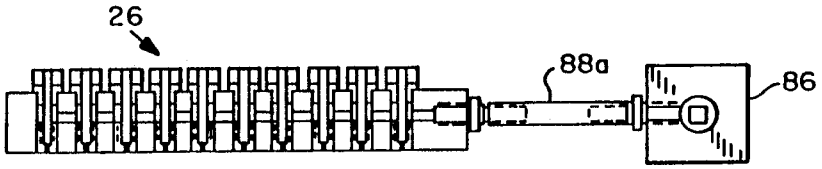
FIG. 5 is a view in the direction of 5 shown in FIG. 3.

Referring to FIGS. 1 and 2, plasma disintegrator 10 comprises a housing 12 having mounted therein a disintegrator chamber 14 with a pivoted closure 16. Chamber 14 typically would be box-like in configuration tilted at a 45 deg. angle with a corner along one edge at the lowest point as illustrated for a purpose to be described.

Extending from the bottom edge of chamber 14 is a funnel member 18 and a tube 22 for exhausting the products of disintegration from the interior of chamber 14. Forming a portion of two adjacent walls of chamber 14 and the apex at the bottom of the latter are a pair of multiplexed plasma nozzle arrays 24 and 26 which are identical but mirror images of each other.

Exhaust tube 22 terminates in a collection chamber 28 passing through a particulate filter 32. Pump inlet tube 34 from chamber 28 is at the top thereof and is connected to the suction side of a vacuum pump 36 which discharges through an electronic precipitator 38 into an outlet tube 42 passing out of housing 12. Vacuum pump 36 continuously withdraws the gaseous products of disintegration from chamber 14 through exhaust tube 22 where the gaseous products pass up through particulate filter 32 and through pump inlet tube 34 as illustrated. The effluent from outlet tube 42 may be discharged into the air although, depending on its constituents, its most valuable components may be separated out first. Some liquid or solid residue in exhaust tube 22 may collect on the bottom of chamber 28, as illustrated.

Nozzle arrays 24 and 26 are supplied with air or other gas such as nitrogen, to be more particularly explained below, by an inlet tube 44 through a pressure regulator 46 and a solenoid operated valve 48 by way of manifold pipes 52 and 54, also to be more particularly described below.

Referring to FIGS. 3-6, multiplexed plasma nozzle array 26 comprises a plurality of identical, extended nozzle assemblies 62*a*-62*j*, ten in the configuration shown, arranged parallel to each and spaced in the manner illustrated.

Figure 6:
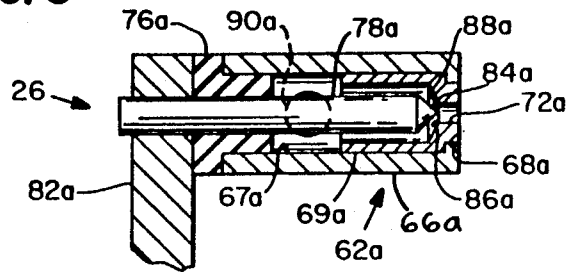
FIG. 6 is a detail 6 taken from FIG. 4.
Figure 4:
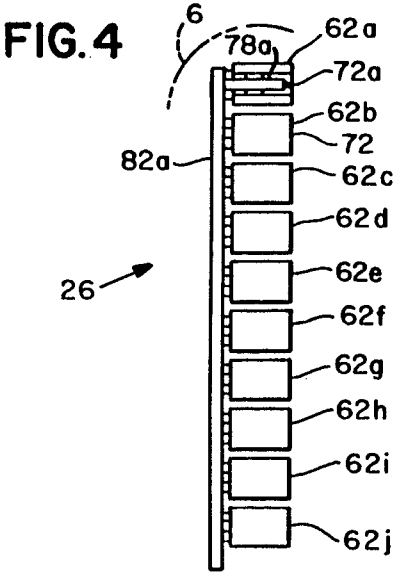
FIG. 4 is a view taken along 4—4 in FIG. 3.

As also seen in FIG. 6, nozzle assembly 62*a* is constructed of an extended member 66*a* with a plurality of sockets 67*a* terminating in openings 68*a*. Member 66*a* is made from a suitable, high temperature electrically conductive material such as a tungsten alloy.

In socket 67*a* is a replaceable nozzle member 69*a* which forms a nozzle opening 72*a* for discharge of the plasma as will be described. Typically nozzle member 69*a* would be made of a high temperature resistant material such as tungsten. Inserted into the opposite end of socket 67*a* is a block 76*a* of electrically insulated material which supports a cylindrical electrode 78*a*.

A copper bus bar 82*a* extending at right angles to member 66*a* helps support one end of an electrode 78*a*, the other end of the latter terminating in a conical tip 84*a* leaving an annular passageway 86*a* between conical tip 84*a* and chamfered surface 88*a* on the inside of nozzle member 66*a*, forming a nozzle. It will be seen from FIG. 3 that copper bar 82*a* supports all of the electrodes behind the nozzle openings in nozzle assemblies 62*a*-62*j* arranged in the column illustrated.

Other copper bars 82*b*-82*j* spaced in a row support the electrodes in columns behind nozzle openings in nozzle assemblies 62*a*-62*j* in the manner illustrated forming a rectangular array of nozzles facing into chamber 14.

Figure 3:
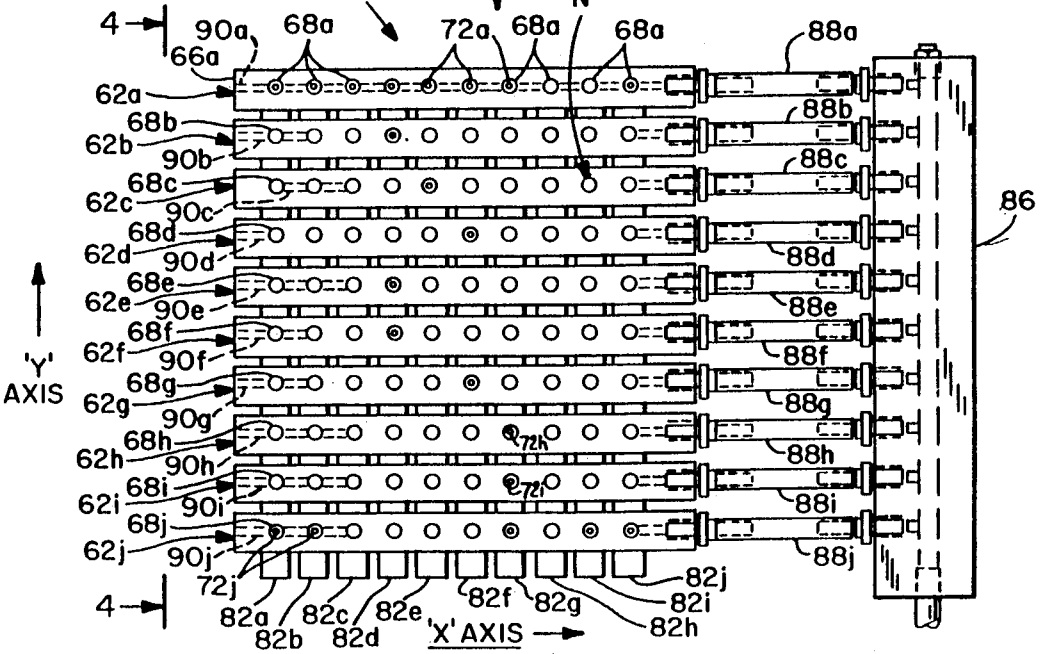
FIG. 3 is a diagrammatic plan view of one multiplexed plasma nozzle array taken from inside of the chamber.

Before proceeding further with the description of the nozzle array, it will be noted from FIG. 3 that the nozzle openings spaced along nozzle assemblies 62*a*-62*j* are arranged in rows and columns. For purposes of discussion, the columns of nozzle openings represent the x-axis numbered 1 to 10 from the left to right as illustrated in this figure. The rows of nozzle openings going from the bottom to top are along the y-axis and are numbered 1 to 10 going from the bottom row up to the top row. Thus, nozzle opening N identified by an arrow is addressed as $x=9$, $y=8$.

Gas is delivered to the nozzles formed within nozzle assemblies 62*a*-62*j* by way of pipe 54 to a manifold 86 conveniently located along one side of array 26. Separate electrically insulated pipes or hoses 88*a*-88*j* deliver the gas from manifold 86 to one end of each of nozzle assemblies 62*a*-62*j* and through drilled holes 90*a*-90*j* which provide communication between sockets 67*a*-67*j* in each nozzle assembly 62*a*-62*j*, respectively. The gas from manifold 54 fills these spaces and exits through nozzle openings 72*a*, 72*b*, 72*c*, etc., into chamber 14 where it will mingle with the vapors formed from the waste being disintegrated.

Referring back to FIG. 6 for a description of the operation of the nozzle containing electrode 78*a*, a high voltage, low current source and a low voltage, high current source, as understood in the art, are connected across electrode 78*a* and nozzle member 69*a*, using bus bar 82*a* and extended member 66*a* to carry the emf. An electrical discharge takes place (the high voltage jumps the gap between tip 84*a* of electrode 78*a* and chamfer 88*a* of nozzle ionization of the gas which becomes conductive and establishes a current path for the current from the low voltage, high current source. The high current flowing heats the gas and sustains the ionization, forming a flame plume which is caused to extend out of nozzle opening 72*a* by the flowing gas which also acts to cool the nozzle. In FIG. 1 a number of flame plumes of plasma 92, 94, and 96 are illustrated.

Operation of the nozzles in arrays 24 and 26 is conducted in a serial or sequential manner so that only one nozzle typically is in operation at any one time. Other arrangements can be produced that will permit multiple nozzles to be active at the same time if desired. This is accomplished by switching current flow between selected x-axis electrode conductors (bus bars 82*a*-82*j*) and y-axis nozzle assemblies 62*a*-62*j*. Thus, to form a plume from nozzle N with address $x=9$, $y=8$, as previously noted, the voltages from the two sources are applied across copper bar 82*i* and nozzle assembly 62*c*.

Referring back to FIG. 1, a bag 98 of trash is placed within container 14 and cover 16 is closed. Flame plumes of plasma within container 14 are established in any preferred sequential order to gradually completely disintegrate bag 98 and its contents, reducing the waste to substantially all gas products which are drawn out through pipe 22. As seen in FIG. 2, additional plasma nozzles 99*a* and 99*b* may be provided in funnel 18 adjacent the entrance to exhaust tube 22 to vaporize any unvaporized products which may pass out of container 14.

Figure 7:
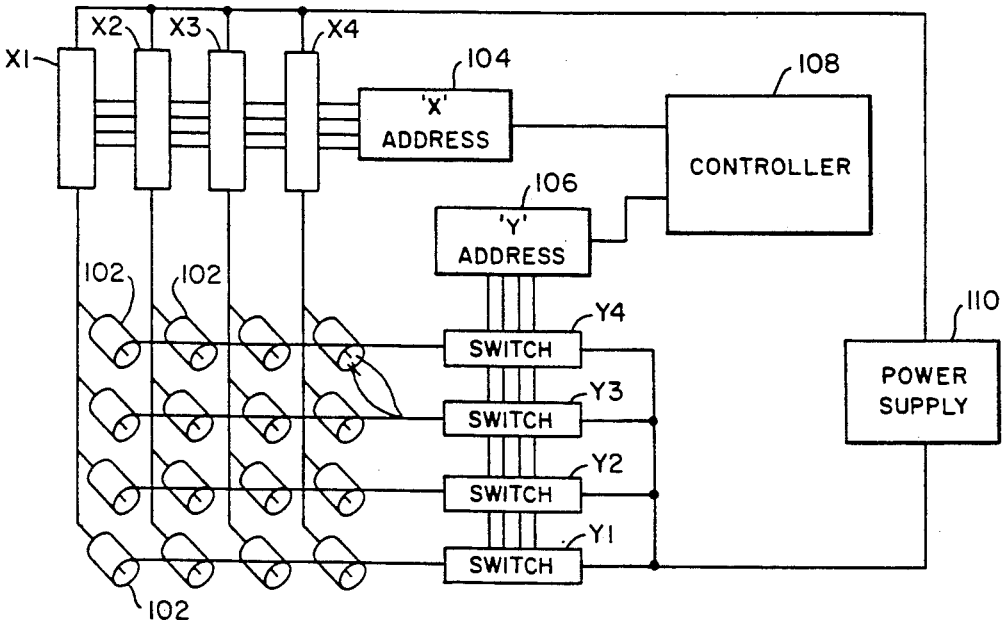
FIG. 7 is a schematic of a control system for use with the embodiment shown in FIGS. 1-6.

The electrical power source and control system for accomplishing the foregoing is illustrated schematically in FIG. 7. An array of plasma flame nozzles 102 similar to the nozzles shown in FIG. 3 are arranged along x and y coordinates with electrical switches X1-X4 controlling electric current flow to the columns of nozzles along the x-axis, and switches Y1-Y4 controlling the flow of current to the rows of nozzles along the y-axis. Switches X1-X4 and Y1-Y4 are controlled by X and Y address directors 104 and 106, respectively. A control system 108, not forming a part of this invention, permits the sequence of nozzles 102 to be energized to be programmed and drives address directors 104 and 106 to open and close switches X1-X4 and Y1-Y4 in the sequence established in controller 108. Electrical current as described earlier is provided to the aforementioned switches from a power supply 110 as illustrated.

In the nozzle construction described, the gas continues to flow in those nozzles in which there are no plumes and maintains them at a low temperature which will prolong their lives. In addition, a nozzle can be energized for a short period of time, and switching from one nozzle to another maintains hot plasmas within chamber 14 so that the bag of trash is continually subject to a disintegrating plasma while any individual nozzle is not at a high temperature for a great length of time effectively extending substantially the useful life of each of the nozzles. Gas conservation can be augmented by inserting solenoid valves in the nozzle openings or in the nozzle array maniforl hoses 88*a*-88*j*, if desired, such valves being controlled by suitable means to supply gas for a prescribed duration and shut off when not needed for plasma flame generation or cooling.

It will be seen that this arrangement makes it possible to disintegrate the bag in stages, following any sequence which has been selected. Because of the ability of the present arrangement to take a complete bag or package of waste products and cause its disintegration in small bites or stages, there is no need for any processing or preparation of the waste products prior to being placed in the disintegration chamber. Consequently there is a reduction in costs and avoids the problem of having processing equipment become contaminated and subject to cleaning.

Also, as earlier noted, another advantage of the present invention is that power requirements are not related directly to the size of the disintegration chamber or the size of any package of waste materials in the chamber. Only the length of time it takes to dispose of the waste products is affected by the size or amount of waste involved. With this invention, therefore, large packages of waste can be processed without the need to increase the amount of power applied.

Figure 8:
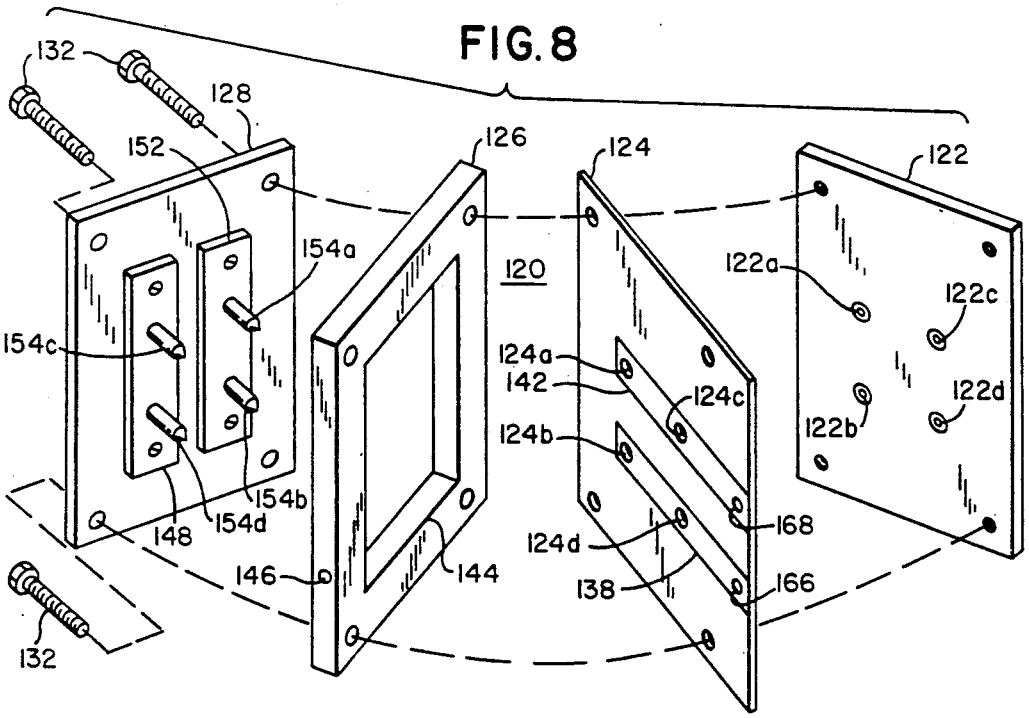
FIG. 8 is an exploded view of another preferred embodiment of this invention.

In accordance with the principles of this invention, other nozzle designs may be employed, for example, the nozzle design shown in FIGS. 8, 9, and 10. A nozzle assembly 120 having a 2×2 nozzle array is made up of nozzle plate 122, a printed circuit board 124, a gasket or spacer 126 of electrically insulating material, and a back plate 128 of electrically insulating material. Bolts 132 hold the assembly together.

Nozzle plate 122 is provided with four identical nozzle openings 122*a*, 122*b*, 122*c* and 122*d* in a rectangular or square array. Columns formed by nozzle openings 122*c*, 122*d* and 122*a*, 122*b* are designated the x-axis while rows formed by nozzles 122*b*, 122*d* and 122*a*, 122*c* are designed the y-axis, so that for example, nozzle opening 122*c* is identified as x=1, y=2.

Nozzle opening 122*c* is formed by a cone-shaped surface 134 in plate 122 facing PC board 124 (see FIG. 9) and a cylindrical opening 136 penetrating nozzle plate 122. The other nozzle openings are all identical in construction, as previously noted.

PC board 124 is provided with openings 124*a*, 124*b*, 124*c*, and 124*d* aligned with openings 122*a*-122*d*, respectively, the Y-rows of openings 124*a*, 124*c* and 124*b*, 124*d* being joined by imprinted circuit connectors 138 and 142, respectively. PC board 124 is made of an insulating material.

Spacer 126 is a window frame in configuration and is provided with an opening 144 and also a hole 146 for gas inlet to be described later.

Backplate 128 of electrically insulating material has mounted on its inside face a pair of conductive bars 148 and 152 from which are protruding electrodes 154*a*, 154*b*, 154*c*, 154*d* which are aligned with openings 124*a*-124*d* and nozzle openings 122*a*-122*d*, respectively, when assembled. Conductive bars 148 and 152 are arranged along the X-axis of the configuration.

As seen in FIG. 10, each nozzle opening can be designed so that any defective nozzle can be replaced. For example, nozzle opening 122*c* can be formed by a block 156 containing nozzle opening 122*c* which is inserted into a larger opening in plate 122 and can readily be replaced.

Referring to FIG. 9, X electrical connections to conductors 148 and 152 can be made through backplate 128 as seen, for example, connector Xl through a screw 158 by lead 159 to conductor 148. Also seen are electrical connectors Y1 and Y2 to circuit conductors 138 and 142, respectively, through bolts 162 and 164. PC board 124 extends out on one side to permit bolts 162 and 164 to pass through openings 166 and 168, respectively.

Gas supplied through opening 146 into the space surrounding electrodes 154*a*-154*d* flows out through nozzle openings 122*a*-122*c* forcing the plasma plume to extend out of nozzle plate 122 as seen in FIG. 9, and also to cool the nozzles and associated structure.

In order to actuate selected nozzles in a predetermined manner, the arrangement shown in FIG. 11 may be employed. It will be see that a high voltage-low current source $E_1$ and a low voltage-high current source $E_2$, of conventional design, are connected in parallel to the X conductors 148 and 152 through switches SWX1 and SWX2. Source $E_2$ is connected in parallel to Y conductors members 138 and 142 in parallel through switches SWY1 and SWY2. A controller 200 which may be under either manual control or through the use of a computer operates switches SWX1, SWX2, SWY1 and SWY2 to select the nozzle to be energized to produce the plasma plume. For example, switches SWX1 and SWY2 can be closed to energize nozzle X1Y2 shown in FIG. 9.

In this design, the nozzles are all contained in a single conductive substrate (they can either be drilled into a common sheet of conductive material or they can be replaceable inserts). The "X" array electrodes are essentially as in the other arrangements, but there is a separate sheet of material for the "Y" array. This sheet of material, (i.e., P.C. board) has horizontal copper "bars" with holes drilled through coincident with the nozzle locations. Each "bar" represents a "Y" array.

To utilize this scheme, one side of the high voltage is connected to the common side of the high current switches SWXl and SWX2, the other side of the high voltage is connected to the common side of the "Y" array switches. The other side of the high current (+) is connected to the common substrate (the nozzles in plate 122). An "X", "Y" coordinate is switched on as in earlier descriptions, but in this case only the high voltage is used to create the initial arc, the ionized gas forms a conductible path for the high current supply and the appropriate nozzle is activated.

This method has the advantage of a common nozzle potential, (typically ground) while retaining the multiplexing capabilities, (by using the high voltage only to select the appropriate nozzle to become active). The high voltage is confined inside the plates that comprise the nozzle assembly. No high current is carried by the "Y" PC material and no plasma is generated at that location to burn the board.

Anticipated other features of this method allows large area plasma application utilizing relatively low power. This suggests portable devices for special needs. The reason it is novel hinges on the fact that the plasma is so hot that it can perform its task (i.e., rapid heat transfer) in a small fraction of the time required by more conventional means. Given that this is a useful trait, then it follows that large areas of material can be treated quickly without the need to physically move the material quickly.

For example, a portable rake-like device, powered by a 2KW generator and a small air compressor, could be used to treat contaminated earth, vaporizing organic materials and leaving sterile soil (oil spills etc.). Also sand, soil, etc. could be fused into glass hard surfaces.

It is thus seen there has been provided a unique method and apparatus for the disposal of certain kinds of waste. While only certain preferred embodiments of this invention have been described it is understood that many variations of this invention are possible without departing from the principles of this invention as defined in the claims which follow.

What is claimed is:

1. Apparatus for disintegrating waste comprising:

(a) chamber means for receiving said waste;

(b) means comprising an array of nozzle means mounted within said chamber means for generating flame plumes of high temperature plasma extending into said chamber means to disintegrate said waste in steps;

(c) means for supplying a gas to said chamber means through said nozzle means; and (d) means for withdrawing from said chamber means said gas containing the disintegration products of said waste produced by said plumes of plasma.

2. The apparatus of claim 1 wherein said array of nozzle means is arranged within said chamber means to permit the disintegration to take place in said steps.

3. The apparatus of claim 2 having means to energize each of said nozzle means to produce a plume of plasma in a predetermined sequence, said gas flowing through each said nozzle means continuously effectively cooling said nozzle means both during energization and when not energized, extending the useful life of each of said nozzle means.

4. The apparatus of claim 3 having means to extract said gas containing said disintegration products.

5. The apparatus of claim 4 having means for filtering said gas extracted from said container to remove any remaining liquid and solid components of said waste.

6. The apparatus of claim 5 in which said chamber means is formed by container means to receive a batch of waste, said container means forming a bottom opening on which said batch of waste resides, said batch being disintegrated in stages by said nozzle means.

7. The apparatus of claim 6 in which said extract means includes outlet means at said bottom opening.

8. The apparatus of claim 1 in which said array of nozzle means comprises a plurality of parallel, spaced extended nozzle members having nozzle openings on the front face along the length of each nozzle member, a plurality of parallel, spaced electric bus bar means arranged vertical to said nozzle members behind said nozzle members, a socket formed in said nozzle members behind each said nozzle opening, an electrode supported at one end by said bus bar means extending into each of said sockets forming nozzles with said nozzle openings.

9. An array of separate nozzles for producing sequentially flame plumes of high temperature plasma comprising:

(a) electrically conductive spaced, flat nozzle means containing nozzle openings on the front face thereof which are formed into an array;

(b) extended electrically conductive spaced means mounted along the rear face of said nozzle means arranged along a Y axis having openings aligned with said nozzle openings;

(c) extended electrically conductive, spaced conductive means arranged along an X axis supporting electrodes extending into said openings forming nozzles so that each nozzle has an X and Y axis address;

(d) means for supplying electric power across said extended X and Y axis spaced conductive means forming flame plumes of high temperature plasma;

(e) means for supplying a cooling gas through said nozzles for directing said plumes out of said nozzle openings thereby cooling all of said nozzles means whether or not energized; and (f) means for controlling the flow of electricity along said X and Y axes so as to produce said plumes in a predetermined sequence of said nozzles.

10. A method for disintegrating waste comprising the steps of:

(a) generating flame plumes of high temperature plasma from an array of nozzles sequentially and in a predetermined order;

(b) exposing said waste to said flame plumes sequentially from said nozzles; and (c) supplying a gas through said nozzles to cool said nozzles and to extend said flame plumes.

11. The method of claim 10 in which said waste is placed in a chamber, said array of nozzles lining a wall of said chamber.

12. The method of claim 11 in which said gas is withdrawn from said chamber containing the disintegration products of said waste produced by said plumes of plasma.

* * * * *